US006464470B1

(12) United States Patent
Zamudio et al.

(10) Patent No.: US 6,464,470 B1
(45) Date of Patent: Oct. 15, 2002

(54) SCROLL COMPRESSOR WITH VARIABLE DISCHARGE PORT

(75) Inventors: Carlos Zamudio, Arkadelphia, AR (US); Joe T. Hill, Bristol, VA (US); Gregory W. Hahn, Arkadelphia, AR (US); Zili Sun, Arkadelphia, AR (US); Jason Hugenroth, Hope, AR (US); Thomas Barito, Arkadelphia, AR (US); John R. Williams, Bristol, VA (US); James W. Bush, Skaneateles, NY (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 09/707,190

(22) Filed: Nov. 6, 2000

(51) Int. Cl.[7] ..... F04B 49/00
(52) U.S. Cl. ..... 417/297; 418/55.1
(58) Field of Search ..... 417/297, 312, 417/213, 441, 310; 418/55.1, 61.1; 137/856

(56) References Cited

U.S. PATENT DOCUMENTS 5,090,880 A * 2/1992 Mashimo ..... 417/310
6,089,839 A * 7/2000 Bush et al. ..... 418/55.1
6,227,830 B1 * 5/2001 Fields et al. ..... 418/55.1

* cited by examiner

*Primary Examiner*—Teresa Walberg
*Assistant Examiner*—Quang Van
(74) *Attorney, Agent, or Firm*—Carlson, Gaskey & Olds

(57) ABSTRACT

A variable size is provided for a discharge port in a scroll compressor. The variable size is movable dependent on conditions within the scroll compressor to achieve a desired pressure ratio based upon operational conditions in the compressor or an associated refrigerant cycle. In one embodiment a plunger moves axially to increase or decrease the size of a discharge port. In a second embodiment, the plunger rotates about an axis and has a groove that is selectively aligned with the port to increase or decrease the effective size of the port.

8 Claims, 2 Drawing Sheets

SCROLL COMPRESSOR WITH VARIABLE DISCHARGE PORT

BACKGROUND OF THE INVENTION

This invention relates to a scroll compressor wherein the size of a discharge port can be varied.

Scroll compressors are becoming widely utilized in refrigerant compression applications. In a scroll compressor, a pair of scroll members each have a base with a generally spiral wrap extending from the base. The wraps interfit to define compression chambers. One of the two scroll members is caused to orbit relative to the other, and as the two orbit a refrigerant entrapped between the wraps is compressed towards a discharge port. Typically, the size of the discharge port will control the pressure ratio, or the amount of compression on the refrigerant. Thus, as a particular volume of refrigerant passes through the compressor, the relative pressure at the discharge point of the compressor is controlled by the design of the discharge port.

At times, it may be desirable to have a lower pressure ratio, and at other times it may be desirable to have a higher pressure ratio. However, to date the design of the scroll compressor has compromised between these two goals, and has only had a fixed size discharge port.

SUMMARY OF THE INVENTION

In disclosed embodiments of this invention, the size of a discharge port in a scroll compressor can be varied based upon operational conditions.

In one embodiment, a plunger is movable adjacent to the discharge port from a position where it sits flush with the base of the scroll member. In this position, the size of the discharge port is at a minimum, and a higher ratio is achieved.

The plunger is selectively movable away from the face of the base of the scroll member such that the size of the discharge port can be made significantly larger. Thus, a lower ratio would be achieved at this position at this position.

In a second embodiment, a plunger rotates, and has a surface such that as it rotates the effective size of the discharge port is varied. In the disclosed embodiment the rotating plunger has a groove on one surface which can be aligned with the port to provide a larger size port, but which can be rotated away from the port to provide a smaller size discharge port.

Appropriate controls can be incorporated into the scroll compressor, or external to the scroll compressor to direct movement of the plungers. Further, the movement of the plungers can be strictly based on conditions within the scroll compressor, such that the plunger is movable based upon pressures, etc.

Further, the movement of the plunger can be infinitely variable, could be to a plurality of discrete locations, or could be between two spaced locations. A worker in the compressor art would recognize the conditions that would cause one to want to vary the pressure ratio, and would further understand how to develop appropriate controls to determine those conditions and then the movement of the plunger.

These and other features of the present invention can be best understood from the following specification and drawings, the following which is a brief description.

DETAILED DESCRIPTION OF A PREFERRED EMBODIMENT

Figure 1:
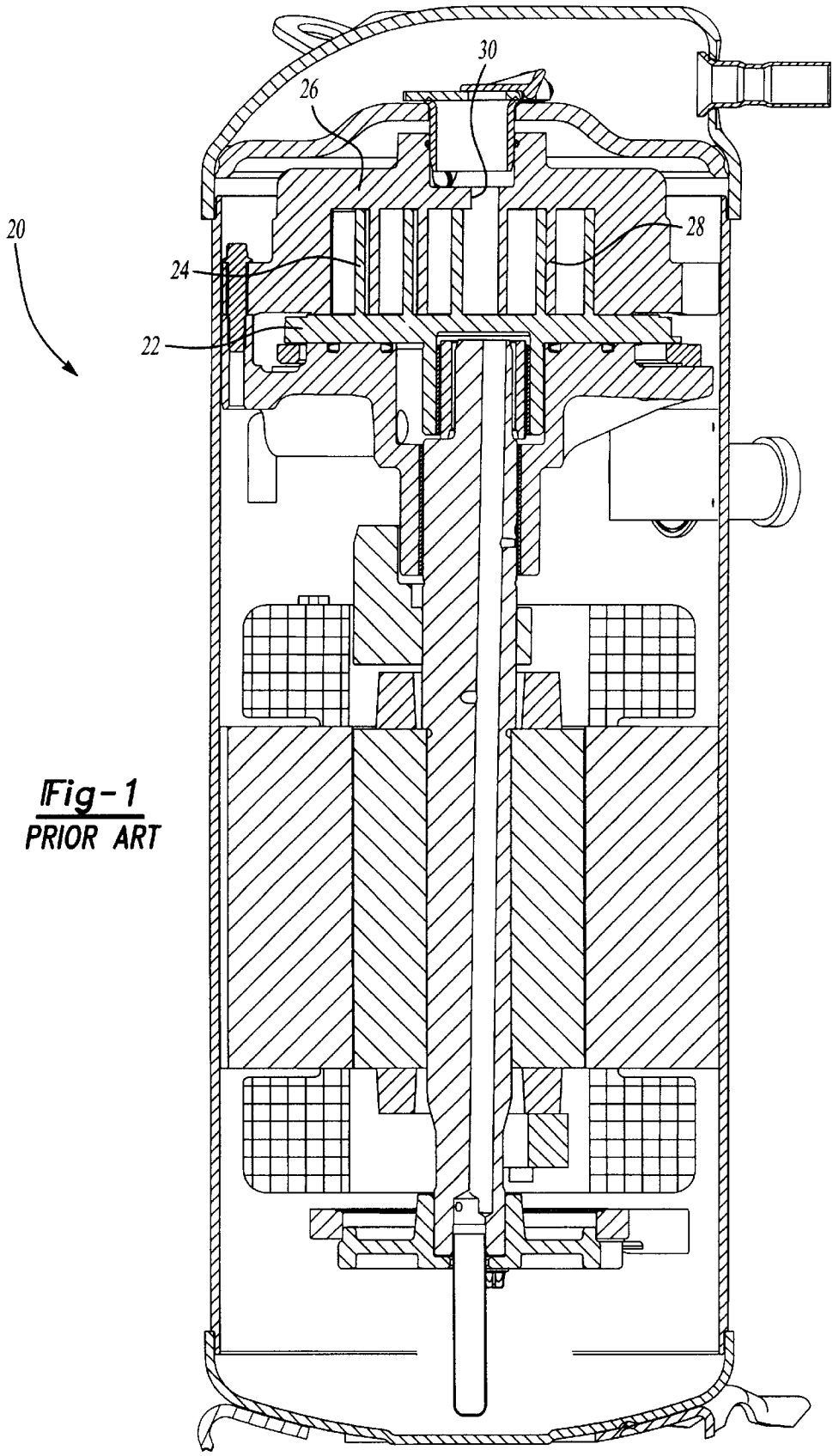
Fig-1 PRIOR ART
FIG. 1 shows a prior art scroll compressor.

A scroll compressor 20 is illustrated in FIG. 1 having an orbiting scroll 22 with a wrap 24 extending from a base, and engaging a non-orbiting scroll 26 having a wrap 28. As is known, a refrigerant enters into a suction port adjacent a radially outer portion of the wraps of the scrolls, and is trapped between the wraps as the orbiting scroll 22 orbits relative to the non-orbiting scroll 26. As the wraps orbit relative to each other, the size of the compression chambers is reduced until the compression chamber communicates with the discharge port 30. The pressure ratio, which is determined by the pressure at suction and the pressure at discharge, is dependent upon several factors, one of which is the size of the discharge port 30 for a given volume of refrigerant. As mentioned above, it would sometimes be desirable to have different pressure ratios. However, this prior art scroll compressor has a fixed discharge port size, which is not variable during operation of the scroll compressor. In at least one proposed compressor, a number of different sized plugs have been utilized to be placed in the discharge port to provide different volumes or cross-sectional areas through the port. However, once these plugs have been inserted, they have not been variable during operation of the compressors.

Figure 2:
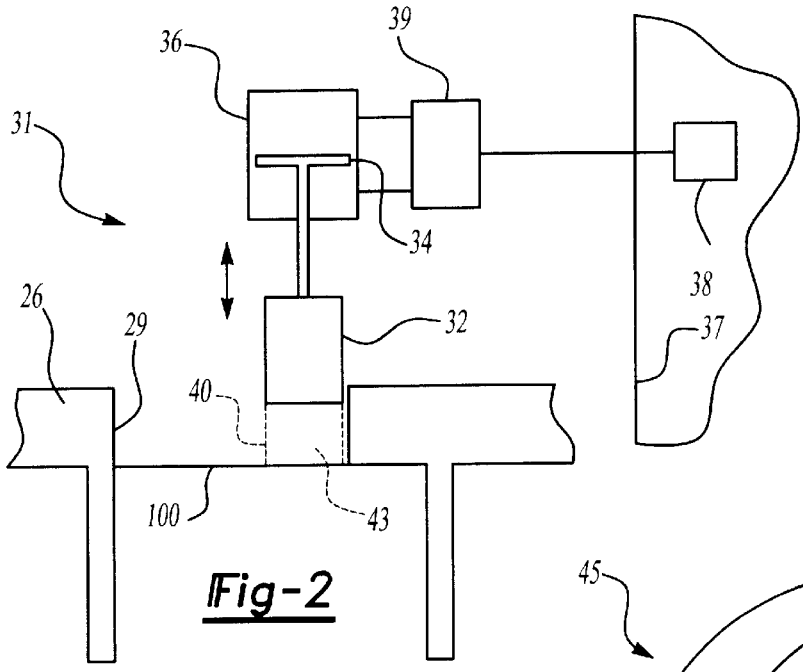
FIG. 2 shows a first embodiment according to this invention.

FIG. 2 shows a first embodiment 31 wherein the size of the discharge port 29 can be varied by movement of a movable plunger 32. As shown somewhat schematically, the movable plunger 32 is received within the non-orbiting scroll 26 base, and has a piston 34 within a cylinder 36. Appropriate fluid controls are shown schematically at 39 for driving the plunger 32. The plunger 32 and the piston 34 can be moved between infinite positions, between two discreet positions, or between a number of discrete positions. As shown in this figure, the housing shell 37 for the scroll compressor has the control 38 for actuating the fluid controls 39 outside of the housing shell 37. Now, when conditions within the compressor or within a refrigerant cycle which incorporates the compressor indicate that it would be desirable to have a larger size at the discharge port 29, the plunger is moved away from an endface 100. An additional volume 43 is provided in the discharge port size 29. If it is desirable to have a smaller discharge port, the plunger 32 is moved forwardly such as to the position 40 shown in phantom. In this position the size of the port 29 is smaller.

Again, a worker in this art would recognize the various conditions and operational variables that would make a larger or smaller port desirable. The scope of this invention is to illustrate a method and apparatus for achieving such variable discharge port size.

Figure 3:
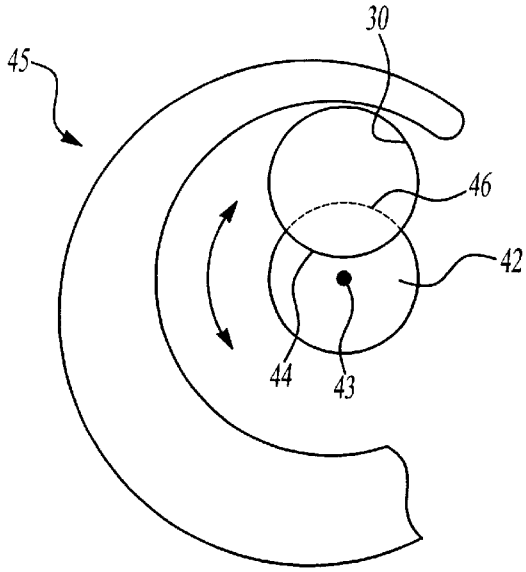
FIG. 3 shows a second embodiment according to this invention.

FIG. 3 shows another embodiment 45 wherein a plunger 42 is rotatable about an axis 43 such that a groove 44 is positioned to either provide a large size for the discharge port 30, or is rotatable to a position shown in phantom at 46 to reduce the size of the port 30.

Figure 4:
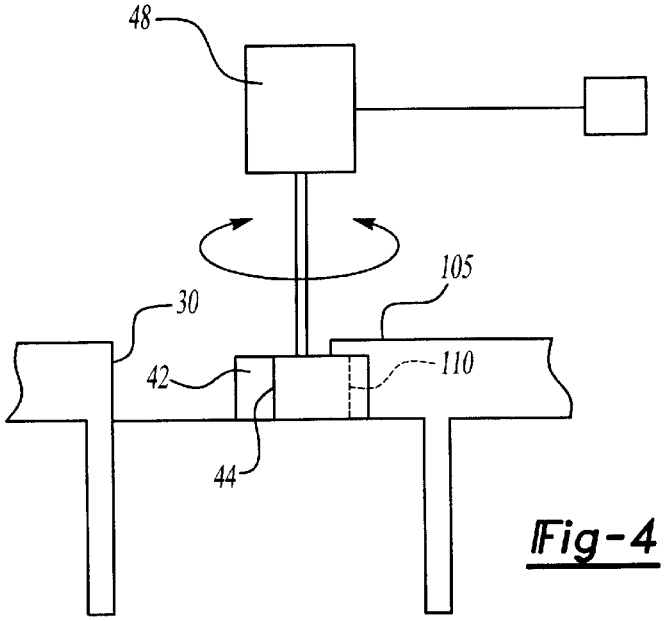
FIG. 4 shows another view of the second embodiment.

As shown in FIG. 4, a rotating motor 48 will drive the plunger 42 between these positions. As with the other embodiment, while the plunger 42 may be simply located to these two positions, it may also be positioned in an infinite number of intermediate positions, or in a number of discrete positions to vary the size of the port 30.

As can be appreciated in FIG. 4, the plunger 42 is positioned beneath a ridge 105 on the base of the non-orbiting scroll. In this way, when the plunger 42 is rotated to the position shown at 46 in FIG. 3, the groove will be at the position shown at 110 in FIG. 4. Thus, the groove will not create additional size at the discharge port 30.

In sum, the present invention discloses several ways of varying the size of a discharge port in a scroll compressor, in this way, the pressure ratio in the scroll compressor can also be varied. Of course, the motor 48 and cylinder 36 are mounted in known fashion with the compressor.

Although preferred embodiments of this invention have been disclosed, a worker in this art would recognize that many modifications would come within the scope of this invention. For that reason the following claims should be studied to determine the true scope and content of this invention.

What is claimed is:

1. A scroll compressor comprising:

a first scroll member having a base and a generally spiral wrap extending from its base;

a second scroll member having a base and a generally spiral wrap extending from its base, said second scroll member being caused to orbit relative to said first scroll member, and said first scroll member having a central discharge port; and the size of said central discharge port being variable during operation of said scroll compressor to change a pressure ratio associated with said scroll compressor.

2. A scroll compressor as recited in claim 1, wherein a plunger is movable within said discharge port to change the effective size of said discharge port.

3. A scroll compressor recited in claim 2, wherein said plunger is movable axially toward and away from a face of said base of said first scroll member.

4. A scroll compressor as recited in claim 3, wherein said plunger is movable within said base of said first scroll member.

5. A scroll compressor as recited in claim 2, wherein said plunger rotates about an axis.

6. A scroll compressor as recited in claim 5, wherein said plunger has a groove at a circumferential location, said groove being aligned with said discharge port to increase the size of said discharge port, and said groove being turned away from said discharge port to reduce the size of said discharge port.

7. A scroll compressor as recited in claim 1, wherein a control for achieving the variation of discharge port size is external to a housing of said compressor.

8. A scroll compressor as recited in claim 1, wherein a control for achieving the variation of the discharge port size is positioned internally to a housing of said compressor.

* * * * *